US007180464B2

(12) United States Patent
Chiang et al.

(10) Patent No.: US 7,180,464 B2
(45) Date of Patent: Feb. 20, 2007

(54) MULTI-MODE INPUT IMPEDANCE MATCHING FOR SMART ANTENNAS AND ASSOCIATED METHODS

(75) Inventors: Bing A. Chiang, Melbourne, FL (US); Joseph T. Richeson, deceased, late of Melbourne, FL (US); by Dee M. Richeson, legal representative, Wood River, IL (US)

(73) Assignee: InterDigital Technology Corporation, Wilmington, DE (US)

( * ) Notice: Subject to any disclaimer, the term of this patent is extended or adjusted under 35 U.S.C. 154(b) by 33 days.

(21) Appl. No.: 11/190,725

(22) Filed: Jul. 27, 2005

(65) Prior Publication Data

US 2006/0022889 A1 Feb. 2, 2006

Related U.S. Application Data

(60) Provisional application No. 60/592,318, filed on Jul. 29, 2004.

(51) Int. Cl.
*H01Q 1/24* (2006.01)
*H01Q 19/00* (2006.01)

(52) U.S. Cl. ..... 343/833; 343/702; 343/834

(58) Field of Classification Search ..... 343/702, 343/818, 833, 834, 846
See application file for complete search history.

(56) References Cited

U.S. PATENT DOCUMENTS

| | | | | |
|---|---|---|---|---|
| 3,846,799 | A | 11/1974 | Gueguen | 343/833 |
| 5,905,473 | A | 5/1999 | Taenzer | 343/834 |
| 6,288,682 | B1 * | 9/2001 | Thiel et al. | 343/702 |
| 6,392,599 | B1 * | 5/2002 | Ganeshmoorthy et al. | 343/700 MS |
| 6,873,293 | B2 * | 3/2005 | Proctor et al. | 343/702 |
| 6,876,331 | B2 * | 4/2005 | Chiang et al. | 343/702 |
| 6,972,729 | B2 * | 12/2005 | Wang | 343/833 |
| 7,106,254 | B2 * | 9/2006 | Jouvie et al. | 343/700 MS |
| 2002/0105471 | A1 * | 8/2002 | Kojima et al. | 343/749 |
| 2003/0156061 | A1 * | 8/2003 | Ohira | 343/372 |
| 2004/0150569 | A1 * | 8/2004 | Proctor et al. | 343/702 |
| 2005/0156797 | A1 * | 7/2005 | Chiang et al. | 343/702 |
| 2006/0022890 | A1 * | 2/2006 | Chiang et al. | 343/833 |
| 2006/0044205 | A1 * | 3/2006 | Lynch et al. | 343/833 |

OTHER PUBLICATIONS

Ohira et al., Electronically Steerable Passive Array Radiator Antennas for Low-Cost Analog Adaptive Beamforming, 0-7803-6345-0/00, 2000, IEEE.

Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.

King, The Theory of Linear Antennas, pp. 622-637, Harvard University Press, Cambridge, Mass., 1956.

Lo et al., Antenna Handbook: Theory, Applications and Design, pp. 21-38, Van Nostrand Reinhold Co., New York, 1988.

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A smart antenna includes a ground plane, an active antenna element adjacent the ground plane and having a radio frequency (RF) input associated therewith, and passive antenna elements adjacent the ground plane. Impedance elements are connected to the ground plane and are selectively connectable to the passive antenna elements for antenna beam steering. Tuning elements are adjacent the passive antenna elements for tuning thereof so that an input impedance of the RF input of the active antenna element remains relatively constant during the antenna beam steering.

34 Claims, 9 Drawing Sheets

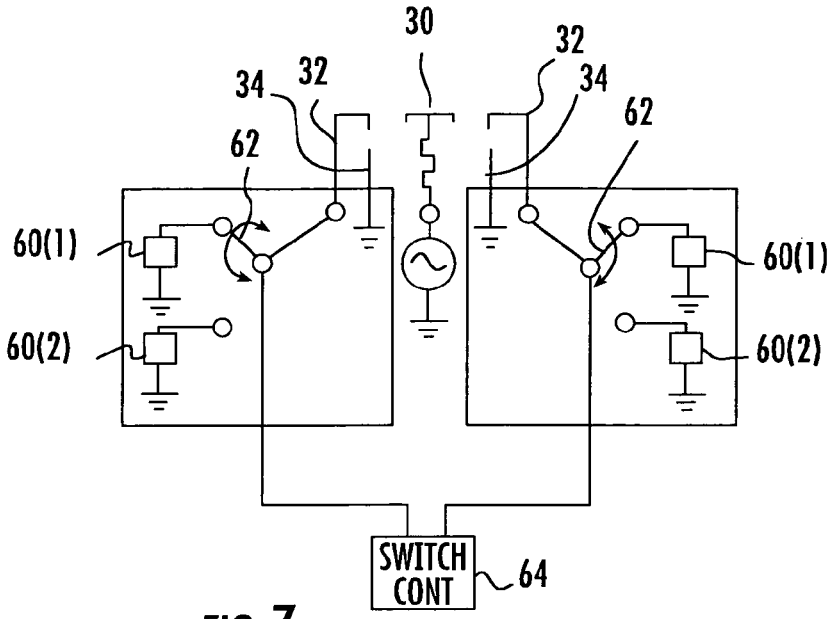
FIG. 7
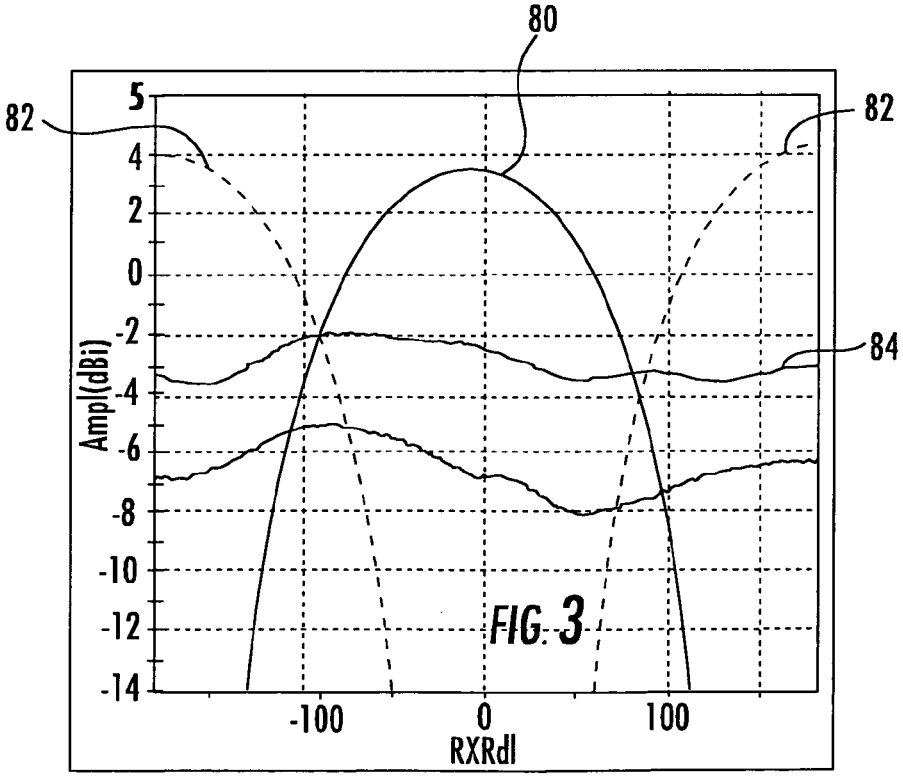
FIG. 3
FIG. 8

MULTI-MODE INPUT IMPEDANCE MATCHING FOR SMART ANTENNAS AND ASSOCIATED METHODS

RELATED APPLICATION

This application claims the benefit of U.S. Provisional Application Ser. No. 60/592,318 filed Jul. 29, 2004, the entire contents of which are incorporated herein by reference.

FIELD OF THE INVENTION

The present invention relates to the field of wireless communication systems, and more particularly, to a smart antenna operating in different antenna beam modes.

BACKGROUND OF THE INVENTION

In wireless communication systems, portable or mobile subscriber units communicate with a centrally located base station within a cell. The wireless communication systems may be a CDMA2000, GSM or WLAN communication system, for example. The subscriber units are provided with wireless data and/or voice services by the system operator and can connect devices such as, for example, laptop computers, personal digital assistants (PDAs), cellular telephones or the like through the base station to a network.

Each subscriber unit is equipped with an antenna. To increase the communications range between the base station and the mobile subscriber units, and for also increasing network throughput, smart antennas may be used. Smart antennas may also be used with access points and client stations in WLAN communication systems. A smart antenna includes a switched beam antenna or a phased array antenna, for example, and generates directional antenna beams.

A switched beam antenna includes an active antenna element and one or more passive antenna elements. Each passive antenna element is connected to a respective impedance load by a corresponding switch. By selectively switching the passive antenna elements to their impedance load, a desired antenna pattern is generated. When a passive antenna element is connected to an inductive load, radio frequency (RF) energy is reflected back from the passive antenna element towards the active antenna element. When a passive antenna element is connected to a capacitive load, RF energy is directed toward the passive antenna element away from the active antenna element. A switch control and driver circuit provides logic control signals to each of the respective switches.

For a switched beam antenna comprising an active antenna element and two passive antenna elements, for example, there are four different switching combinations for selecting a desired antenna beam if the switch is a single pole double throw (SPDT). Each switching combination corresponds to a different antenna beam mode, and consequently, the input impedance to the active antenna element changes between the difference modes. The efficiency of the smart antenna varies as the input impedance varies.

Similarly, in a phased array antenna, when the relative phases fed to the respective antenna elements are changed, the input impedances also vary. The phase changes are integral to the beam scanning and adaptive beam forming of a phased array antenna. This makes it difficult to match the input impedances of the various modes. To obtain a reasonable match for required beam shapes and positions, dynamic matching circuits are often used, which further add to the complexity and cost of a phased array antenna.

SUMMARY OF THE INVENTION

In view of the foregoing background, it is therefore an object of the present invention to match the input impedances of a smart antenna when operating in different antenna beam modes.

This and other objects, features, and advantages in accordance with the present invention are provided by a smart antenna comprising a ground plane, an active antenna element adjacent the ground plane and having a radio frequency (RF) input associated therewith, and a plurality of passive antenna elements adjacent the ground plane. A plurality of impedance elements is connected to the ground plane and is selectively connectable to the plurality of passive antenna elements for antenna beam steering. A plurality of tuning elements is adjacent the plurality of passive antenna elements for tuning thereof so that an input impedance of the RF input of the active antenna element remains relatively constant during the antenna beam steering.

The tuning elements are used to match the input impedances of the multiple antenna modes of the smart antenna by tuning the passive antenna elements. The tuning elements are essentially sub-resonant parasitic antenna elements, and are sized so that they do not interfere with the antenna patterns generated by the smart antenna. A Smith chart is used to determine the size, shape and spacing of the tuning elements, which varies between the particular applications of the smart antenna.

The tuning elements may be connected to ground. The passive antenna elements may define at least one resonant frequency, while tuning elements preferably define at least one sub-resonant frequency. The tuning elements may be positioned between the active antenna element and the passive antenna elements. At least one tuning element is adjacent a respective passive antenna element for tuning thereof.

The smart antenna may further comprise a dielectric substrate. The active antenna element, the passive antenna elements and the tuning elements may be carried by the dielectric substrate. The smart antenna may also further comprise a plurality of switches for selectively connecting the plurality of passive antenna elements to the plurality of impedance elements. Each impedance element may be associated with a respective passive antenna element. Each impedance element may comprise an inductive load and a capacitive load, with the inductive load and the capacitive load being selectively connectable to the respective passive antenna element.

Another aspect of the present invention is directed to a mobile subscriber unit comprising a smart antenna as defined above for generating a plurality of antenna beams, a beam selector controller connected to the smart antenna for selecting one of the plurality of antenna beams, and a transceiver connected to the beam selector and to the smart antenna.

Yet another aspect of the present invention is directed to a method for matching an input impedance of a smart antenna as defined above. The method preferably comprises tuning the passive antenna elements by positioning the tuning elements adjacent thereof so that the input impedance of the RF input of the active antenna element remains relatively constant during the antenna beam steering.

BRIEF DESCRIPTION OF THE DRAWINGS

FIG. 7 is a schematic diagram of the switch and impedance elements for the passive antenna elements in accordance with the present invention.

FIG. 8 is a graph illustrating the various antenna modes for the smart antenna shown in FIG. 1.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
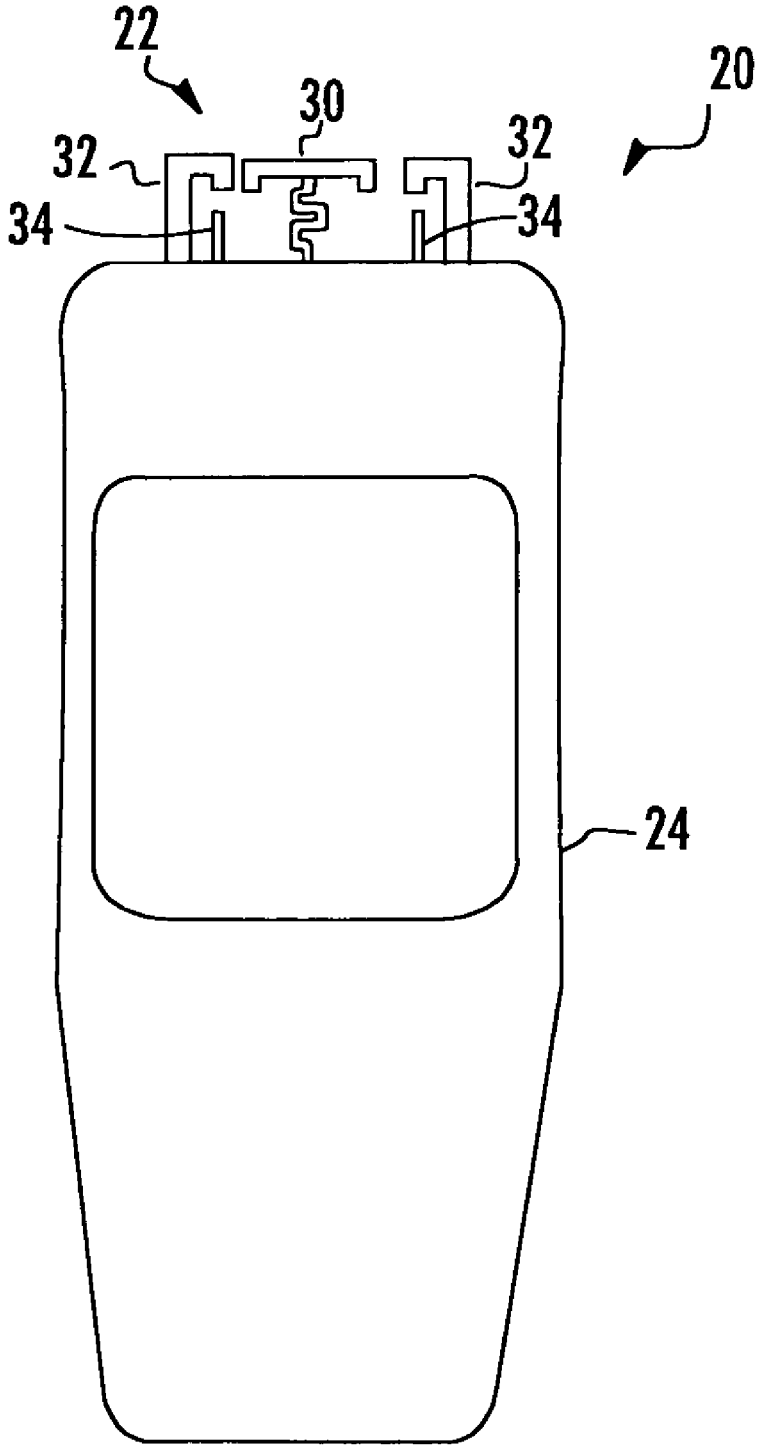
FIG. 1 is a schematic diagram of a mobile subscriber unit with a smart antenna in accordance with the present invention.
Figure 2:
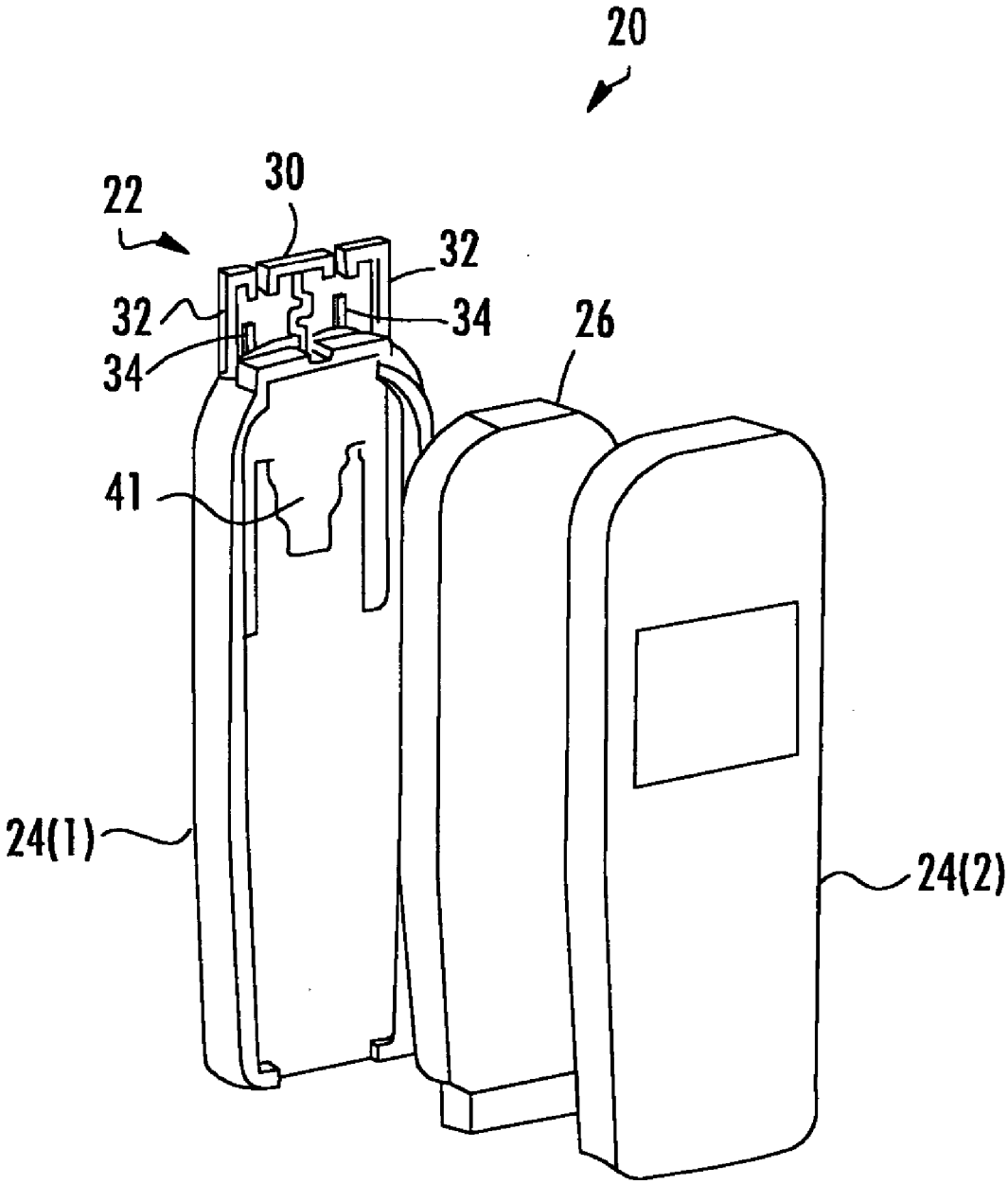
FIG. 2 is an exploded view illustrating integration of the smart antenna in the mobile subscriber unit shown in FIG. 1.
Figure 3:
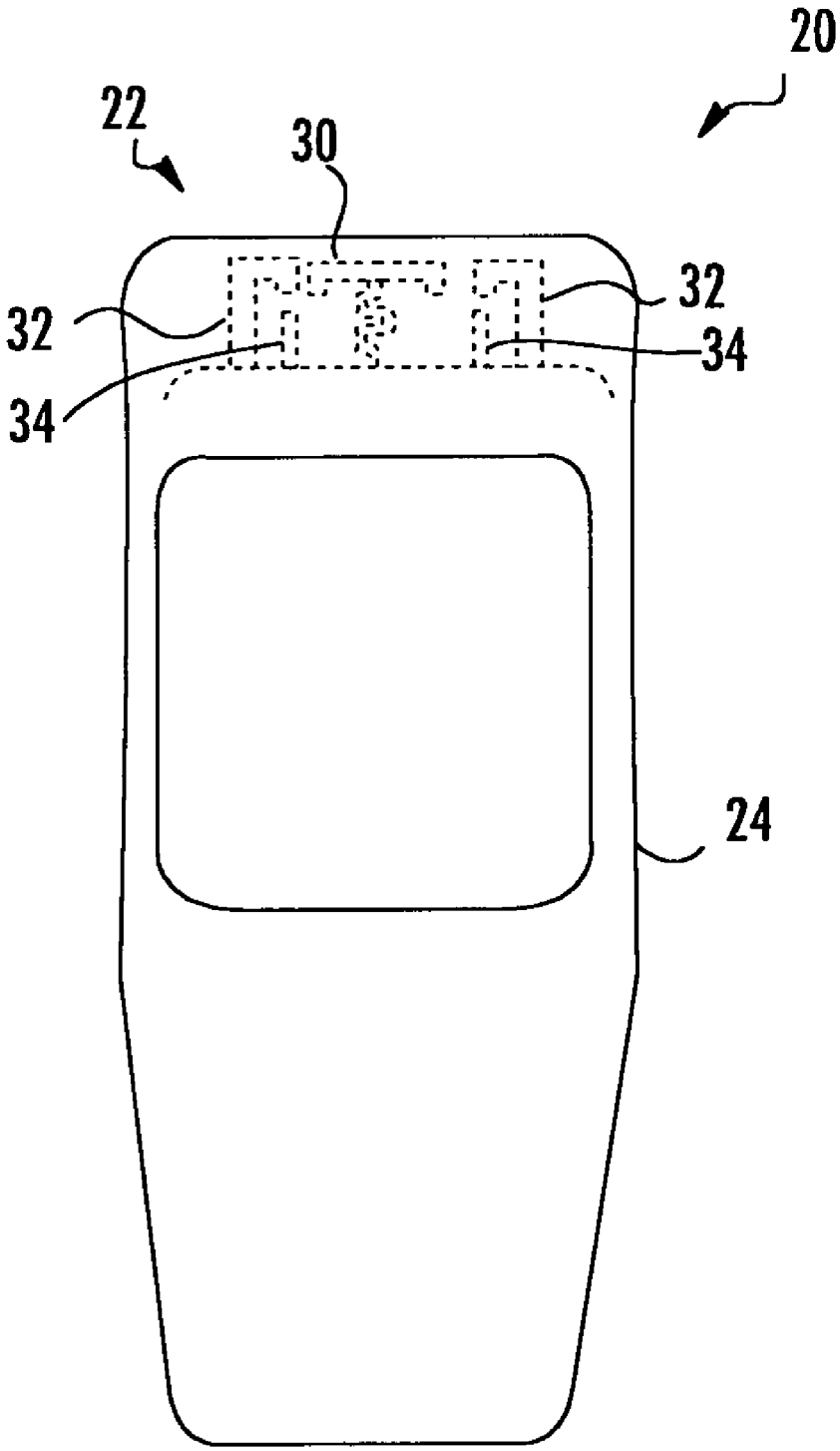
FIG. 3 is a schematic diagram of the smart antenna shown in FIG. 1 internal the mobile subscriber unit.
Figure 4:
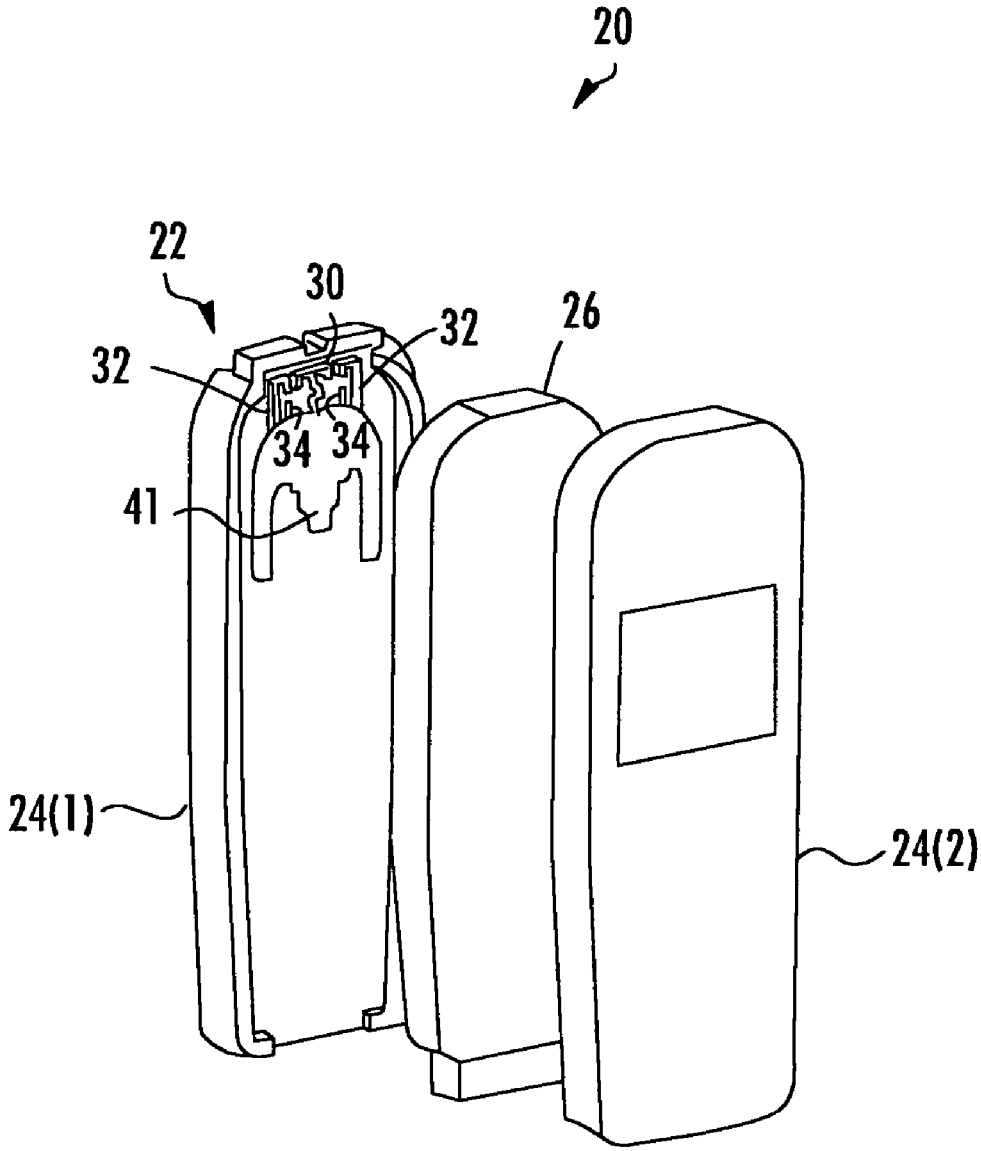
FIG. 4 is an exploded view illustrating integration of the smart antenna in the mobile subscriber unit shown in FIG. 3.

Referring initially to FIGS. 1–4, the illustrated mobile subscriber unit 20 includes in FIGS. 1 and 2 a smart antenna 22 that protrudes from the housing 24 of the mobile subscriber unit 20, and in FIGS. 3 and 4 a smart antenna that is internal the housing 24. In both cases, the smart antenna 22 includes an active antenna element 30, a plurality of passive antenna elements 32 defining at least one resonant frequency, and a plurality of tuning elements 34 defining at least one sub-resonant frequency.

As will be discussed in greater detail below, the tuning elements 34 are used to match the input impedances of the multiple antenna modes of the smart antenna 22 by tuning the passive antenna elements 32. The tuning elements 34 are essentially sub-resonant parasitic antenna elements, and are sized so that they do not interfere with the antenna patterns generated by the smart antenna 22. Size, shape and spacing of the tuning elements 34 vary between the particular applications of the smart antenna 22.

The smart antenna 22 provides for directional reception and transmission of radio communication signals with a base station in the case of a cellular handset, or from an access point in the case of a wireless data unit making use of wireless local area network (WLAN) protocols.

In the exploded views of FIGS. 2 and 4 illustrating integration of the smart antenna 22 into the mobile subscriber unit 20, the smart antenna is formed on a printed circuit board and placed within a rear housing 24(1) of the mobile subscriber unit. A center module 26 may include electronic circuitry, radio reception and transmission equipment, and the like. An outer housing 24(2) may serve as, for example, a front cover of the mobile subscriber unit 20. When the rear and outer housings 24(1), 24(2) are connected together, they form the housing 24 of the mobile subscriber unit 20.

The printed circuit board implementation of the smart antenna 22 can easily fit within a handset form factor. In an alternate embodiment, the smart antenna 22 may be formed as an integral part of the center module 26, resulting in the smart antenna and the center module being fabricated on the same printed circuit board. The ground portion 41 of the smart antenna 22 is embedded inside the housing 24.

Protrusion of the active and passive antenna elements 30 and 32 as well as the tuning elements 34 allows the elements to radiate freely. Although not illustrated, a protective coating or shield may optionally cover the active and passive antenna elements 30, 32 and the tuning elements 34. The illustrated shape of the active and passive antenna elements 30, 32 reduces the height of the smart antenna 22 protruding from the housing 24 of a mobile subscriber unit 20 to improve portability and appearance, as readily appreciated by those skilled in the art.

Figure 5:
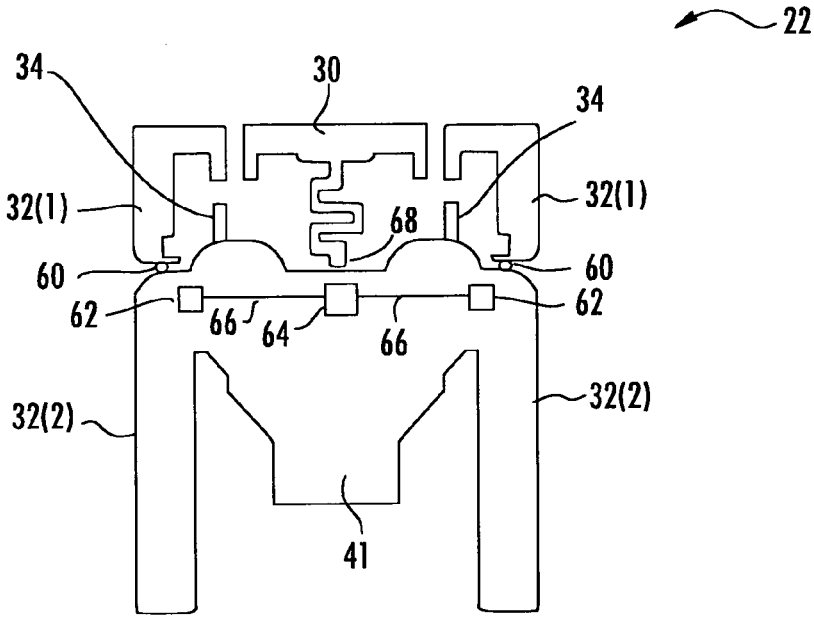
FIG. 5 is a schematic diagram of the smart antenna shown in FIGS. 1–4.
Figure 6:
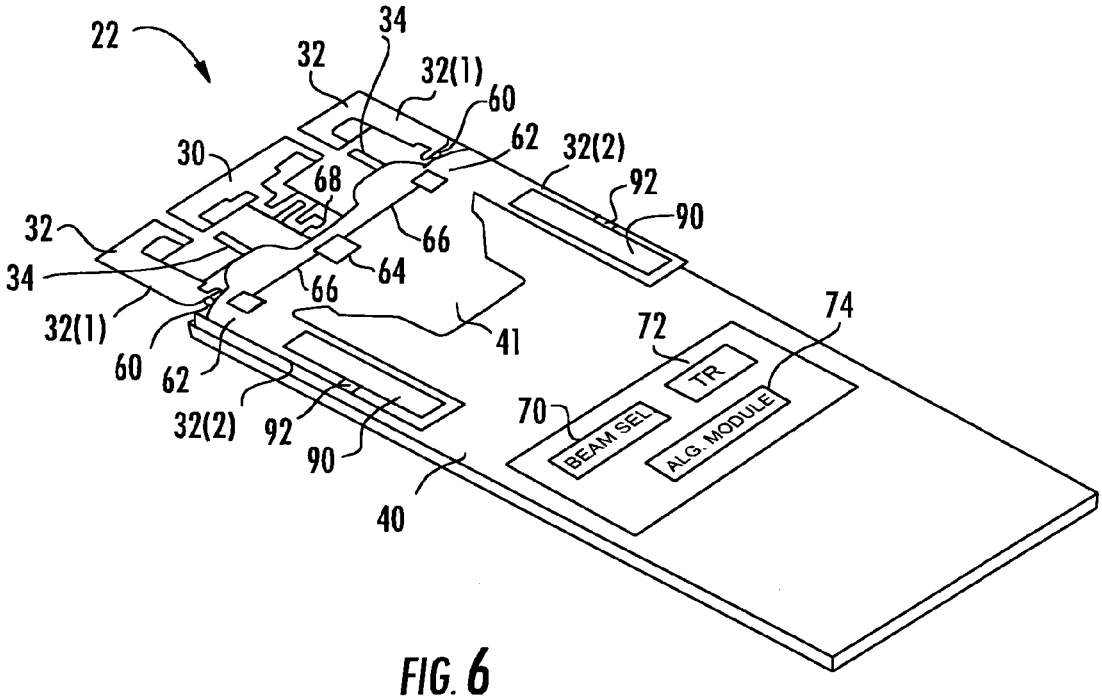
FIG. 6 is a schematic diagram of the smart antenna shown in FIG. 5 on a dielectric substrate in close proximity to other handset circuitry.

The smart antenna 22 will now be discussed in greater detail with reference to FIGS. 5–7. The smart antenna 22 is disposed on a dielectric substrate 40 such as a printed circuit board, including the center active antenna element 30, the outer passive antenna elements 32 and the tuning elements 34. Each of the passive antenna elements 32 can be operated in a reflective or directive mode.

The tuning elements 34 are parasitic antenna elements, and are sized so that they define a sub-resonant frequency that is less than the resonant frequencies defined by the passive antenna elements. This ensures that the tuning elements 34 do not interfere with the antenna patterns generated by the smart antenna 22. The illustrated tuning elements 34 are monopole antenna elements connected to ground 41.

Since the illustrated smart antenna 22 is a low profile antenna, the active antenna element 30 comprises a conductive radiator in the shape of a "T" disposed on the dielectric substrate 40. The passive antenna elements 32 are also disposed on the dielectric substrate 40 and each comprises an inverted L-shaped portion laterally adjacent the active antenna element 30. The T-shaped active antenna element 30 and the L-shaped portions of the passive antenna elements 32 advantageously reduce the height of the smart antenna 22 protruding from the housing 24 of the mobile subscriber unit 20.

Reduction in the length of protrusion of the active antenna element 30 from the housing 24 of the mobile subscriber unit 20 is accomplished by providing a top loading, and at the same time providing a slow wave structure for the body of the antenna. One of the technologies available for radiating element size reduction is meander-line technology. Other techniques can include dielectric loading, and corrugation, for example. The illustrated structure for the active antenna element 30 is a meander-line, which is illustrated as an example.

The use of the tuning elements 34 is not limited to a low-profile smart antenna 22. The active and passive antenna elements 30, 32 may be standard monopole shaped antenna elements, as readily appreciated by those skilled in the art. The active antenna element 30, the passive antenna elements 32 and the tuning elements 34 are preferably fabricated from a single dielectric substrate such as a printed circuit board with the respective elements disposed thereon. The antenna elements 30, 32 and the tuning elements 34 can also be disposed on a deformable or flexible substrate.

The illustrated passive antenna elements 32 each have an upper conductive segment 32(1) (including the L-shaped portion) as well as a corresponding lower conductive segment 32(2). The height of the passive antenna elements 32 is reduced by bending the top portion thereof to produce the inverted L-shape. Alternatively, top loading may be used.

The inverted L-shape is made to meet the top loading segment of the active antenna element 30, but not touching, in such a manner that more power can be coupled from the active antenna element 30 to the passive antenna elements 32 for optimum beam formation. The height of the active antenna element 30 and the upper conductive segment 32(1) of the passive antenna elements 32 shown in the figure is 0.6 inches, which corresponds to the smart antenna 22 operating at a frequency of 1.87 GHz.

Gain is expected to be reduced when the physical size of the smart antenna 22 is reduced. In some size constrained cases, this gain reduction may be acceptable to meet packaging requirements. However, a variety of techniques can be used to reduce this loss. Since the desired height reduction is in the portion of the smart antenna 22 outside the housing 24, the length of the embedded portion, i.e., the lower conductive elements 32(2), can be increased to compensate for the reduced height.

This in effect turns the passive antenna elements 32 into offset fed dipoles. The passive antenna elements 32 perform as reflector/director elements with controllable amplitude and phase. For a passive antenna element 32 to operate in either a reflective or directive mode, the upper conductive segment 32(1) is connected to the lower conductive segment 32(2) via at least one impedance element 60. The at least one impedance element 60 comprises a capacitive load 60(1) and an inductive load 60(2), and each load is connected between the upper and lower conductive segments 32(1), 32(2) via a switch 62. The switch 62 may be a single pole, double throw switch, for example.

When the upper conductive segment 32(1) is connected to a respective lower conductive segment 32(2) via the inductive load 60(2), the passive antenna element 32 operates in a reflective mode. This results in radio frequency (RF) energy being reflected back from the passive antenna element 32 towards its source, i.e., the active antenna element 30.

When the upper conductive segment 32(1) is connected to a respective lower conductive segment 32(2) via the capacitive load 60(2), the passive antenna element 32 operates in a directive mode. This results in RF energy being directed toward the passive antenna element 32 away from the active antenna element 30.

A switch control and driver circuit 64 provides logic control signals to each of the respective switches 62 via conductive traces 66. The switches 62, the switch control and driver circuit 64 and the conductive traces 66 may be on the same dielectric substrate 40 as the antenna elements 30, 32 and the tuning elements 34.

As noted above, electronic circuitry, radio reception and transmission equipment, and the like may be on the center module 26. Alternatively, this equipment may be on the same dielectric substrate 40 as the smart antenna 22. As illustrated in FIG. 6, this equipment includes a beam selector 70 for selecting the antenna beams, and a transceiver 72 coupled to a feed 68 of the active antenna element 30.

An antenna steering algorithm module 74 runs an antenna steering algorithm for determining which antenna beam provides the best reception. The antenna steering algorithm operates the beam selector 70 for scanning the plurality of antenna beams for receiving signals.

Since a two-position switch 62 is used for each of the two passive antenna elements 32, four antenna modes are available. In other words, each switching combination corresponds to a different antenna mode. The input impedance to the active antenna element changes between the difference antenna modes. Ideally, the input impedance is 50 ohms. However, this value changes among the four different antenna modes, which in turn reduces the efficiency of the smart antenna 22. When the efficiency of the smart antenna 22 is reduced, the VSWR is increased.

The four different antenna modes for the smart antenna 22 are illustrated in FIG. 8. The smart antenna 22 is operating at a frequency of 1.87 GHz. Line 80 represents one of the passive antenna elements in a directive mode with the other passive antenna element in a reflective mode. Line 82 is similar to line 80 and represents a reverse in the reflective/directive modes for the respective passive antenna elements 32. Line 82 has the same antenna gain as the antenna gain associated with line 80. Line 84 represents both of the passive antenna elements 32 in a directive mode, which corresponds to an omni-directional peak antenna gain of about 2 dBi. Line 86 represents both of the passive antenna elements 32 in a reflective mode, which corresponds to a peak antenna gain of about −5 dBi.

The tuning probes 34 will now be discussed in greater detail. The tuning probes 34 are miniature parasitic antenna elements that are used to fix-tune each passive antenna element 32. These miniature elements are essentially sub-resonant parasitic antennas. When monopoles are used, the sub-resonant antennas are connected to ground 41. The tuning probes 34 are sized so that they define a sub-resonant frequency so that they do not interfere with the radiation patterns generated by the passive antenna elements 32. When multiple tuned states are required by the smart antenna 22, more than one sub-resonant parasitic element may be used for each passive antenna element 32.

The tuning elements 34 are designed with the proper size, shape and spacing from their host passive antenna elements 32 to be effective. The manner that the tuning elements 34 can fit between the active antenna element 30 and the passive antenna elements 32 inside the array aperture is particularly useful for wireless applications because of the need for compactness. A valuable design aid in the design process for selecting the size/shape/spacing of the tuning elements 34 is the use of a Smith chart, wherein the loci of the Smith chart indicates the tuned condition of the passive antenna elements 32.

The loci can be generated through simulation or hardware testing. The effect of the tuning elements 34 appears as miniature loops formed in the loci. The approach for matching the various antenna modes of the smart antenna 22 is to adjust the shape, size and spacing of the tuning elements 34 so that the miniature loops can fall within the operating band. There should normally be one loop for each sub-resonant tuning element 34 unless they overlap, and there should normally be one locus trace for each passive antenna element 32.

Figure 9:
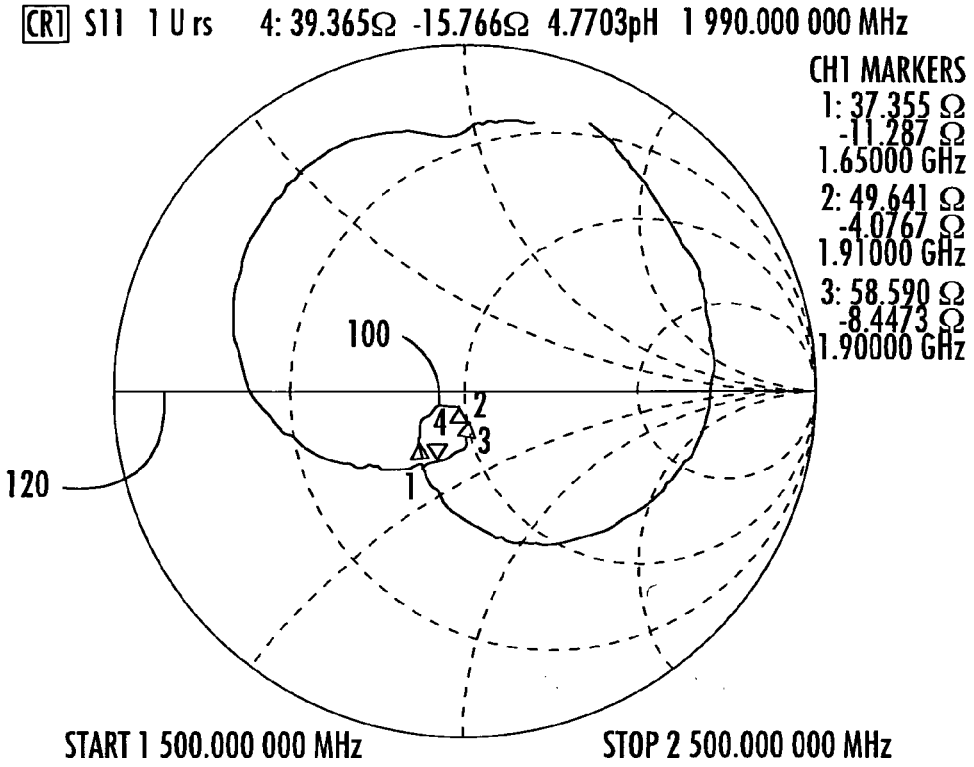
FIG. 9 is a Smith chart for a smart antenna operating in a directional mode without the tuning elements in accordance with the present invention.
Figure 10:
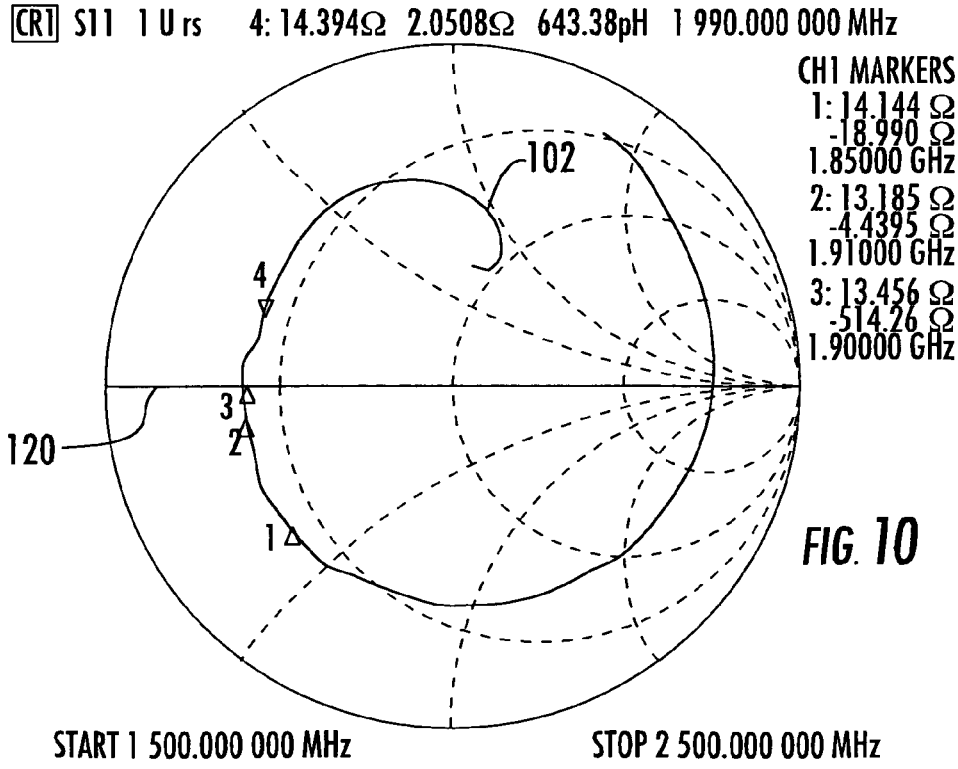
FIG. 10 is a Smith chart for a smart antenna operating in an omni-directional mode without the tuning elements in accordance with the present invention.

Referring now to FIG. 9, a Smith chart of a smart antenna operating in a directional mode without the tuning elements 34 is provided. Likewise, FIG. 10 illustrates a Smith chart of a smart antenna operating in an omni-directional mode without the tuning elements 34. The Smith charts respectively illustrate the measured input impedance of a directional mode and an omni-directional mode without the tuning elements 34 being adjacent the passive antenna elements 32. In FIG. 9, a small resonant loop 100 is formed in the frequency band of operation. The smart antenna without the tuning elements 34 is somewhat matched in the directional mode. Ideally, the small resonant loop 100 should be in the center of the Smith chart.

In contrast, the Smith chart for the omni-directional mode, as illustrated in FIG. 10, is not optimized for a good impedance match without overly sacrificing the match of the beam mode. A partial resonant loop 102 is formed in the high frequency range. There are two reasons for the prior art smart antenna to not have a good impedance match. First, the band center, or the frequency markers' centroid is not near the horizontal axis 120. Second, the frequency markers are spread out. Any attempt to move the band center to the chart center by impedance matching at the feed will move the band center of the directional mode away from the center. To move the markers closer together as illustrated in FIG. 10 requires the creation of a small resonant loop.

Using circuit components like inductors and capacitors cannot match the input to the different antenna beam modes. This is due to the fact that circuits can vary the input impedance match only in the frequency domain, but not in the modal domain. To effect changes in the modal domain, we have to work within the radiation space, thus the parasitic probes.

The small resonant loop may be obtained through the use of the tuning probes 34 being placed adjacent the passive antenna elements 32. The tuning elements 34 are placed between the active element 30 and the passive antenna elements 32. This placement does not increase the physical size of the smart antenna 22. The inserted tuning elements 34 are kept short, and their small size limits their effect on the radiation patterns of the smart antenna 22.

Figure 11:
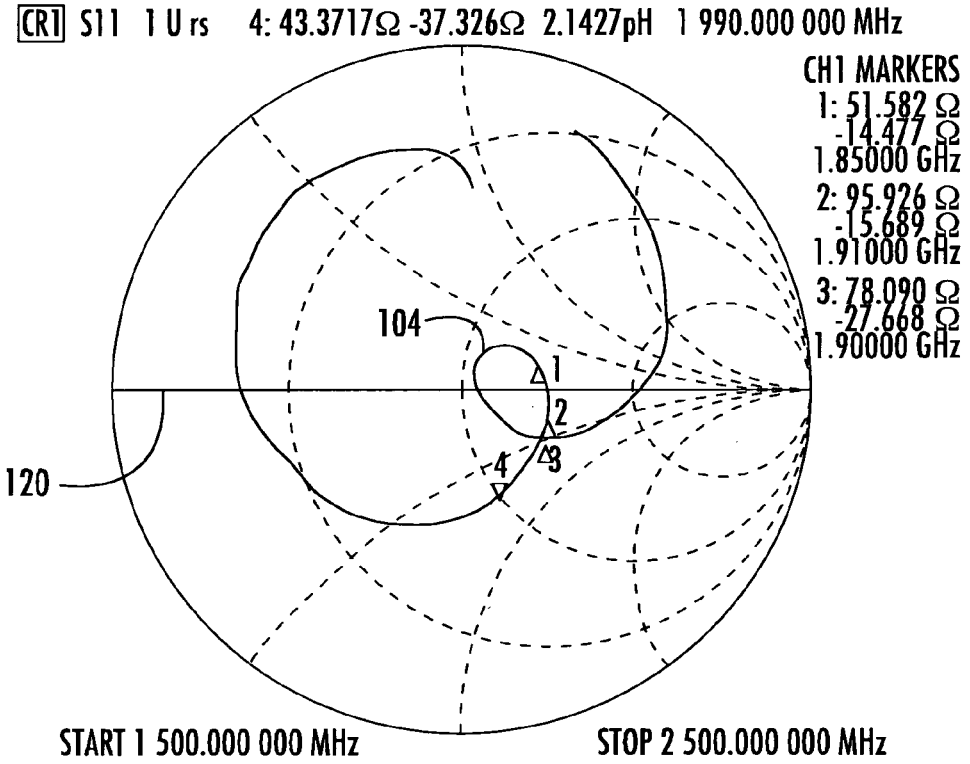
FIG. 11 is a Smith chart for a smart antenna operating in a directional mode with the tuning elements in accordance with the present invention.
Figure 12:
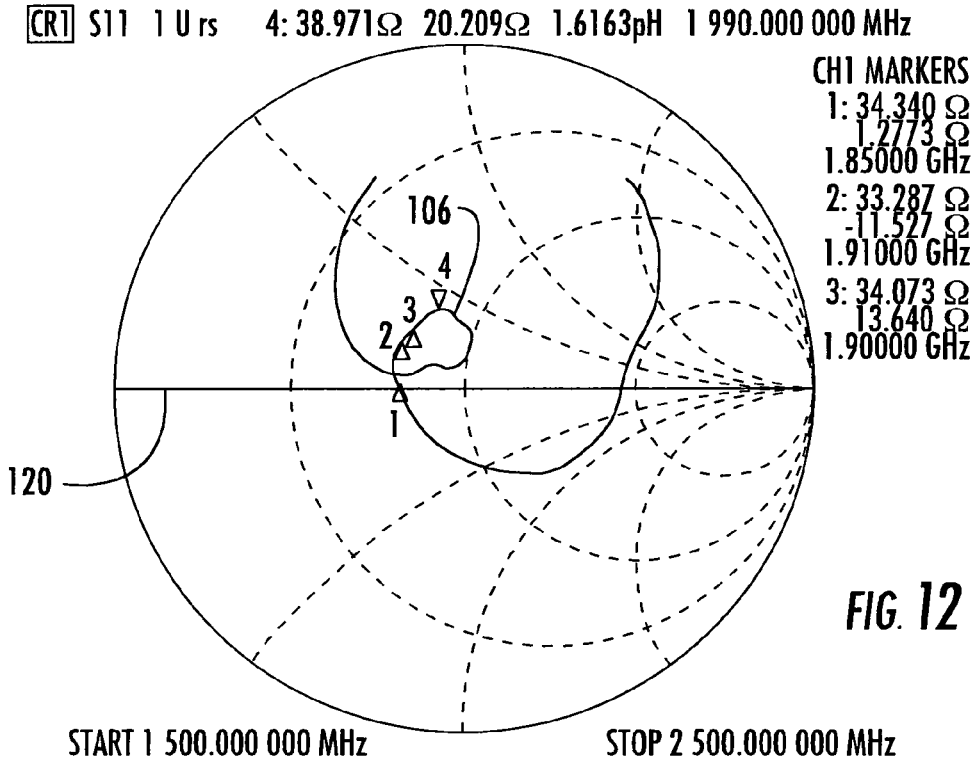
FIG. 12 is a Smith chart for a smart antenna operating in an omni-directional mode with the tuning elements in accordance with the present invention.

Referring now to FIG. 11, a Smith chart for the smart antenna 22 operating in a directional mode with the tuning elements 34 is provided. Likewise, FIG. 12 illustrates a Smith chart for the smart antenna 22 operating in an omni-directional mode with the tuning elements 34. The impedance match of the omni-directional mode sees a significant improvement. The small resonant loop 106 for the omni-directional mode is moved closer to the center of the Smith chart (FIG. 12). In addition, the small resonant loop 104 is improved even more by moving the small resonant loop 104 closer to the center of the Smith chart (FIG. 11).

The tuning elements 34 thus have little effect on the already well-tuned directional mode. The key point is that the small resonant loop 104 is still there, but with slight changes in location and size. FIG. 12 illustrates that the tuning elements 34 add a small resonant loop 106 to the locus of the omni-directional mode. The resonant loop 106 pulls the in-band markers together, and moves them close to the chart center. The return loss of each mode is below the −9 dB level.

In review, the tuning elements 34 perturb the near field space of the passive antenna elements 32, and consequently, changes the input impedance so that it is more consistent for the different antenna modes. The Smith chart is a tool that is used to determine the size and shape of the tuning elements 34, as well as their spacing from the passive antenna elements 32. For example, the spacing of each tuning element 34 may vary within a range of ⅛ the wavelength of the operating frequency to 1/100 the wavelength. A nominal spacing may be on the order of about 1/20 the wavelength, for example.

The size and shape of the tuning elements 34 are selected so that the overall effect is less than ¼ the wavelength. For example, the height of each tuning elements 34 may vary within a range of 20% to 80% of the height of the passive antenna elements 32. A nominal height may be on the order of about 60%, for example. The Smith chart thus provides feedback on how the tuning elements 34 effect location of the small resonant loop 104 and 106. Once the small resonant loops 104 and 106 are located in the center of the Smith chart, the input impedance matching for the different modes will remain relatively constant.

Figure 13:
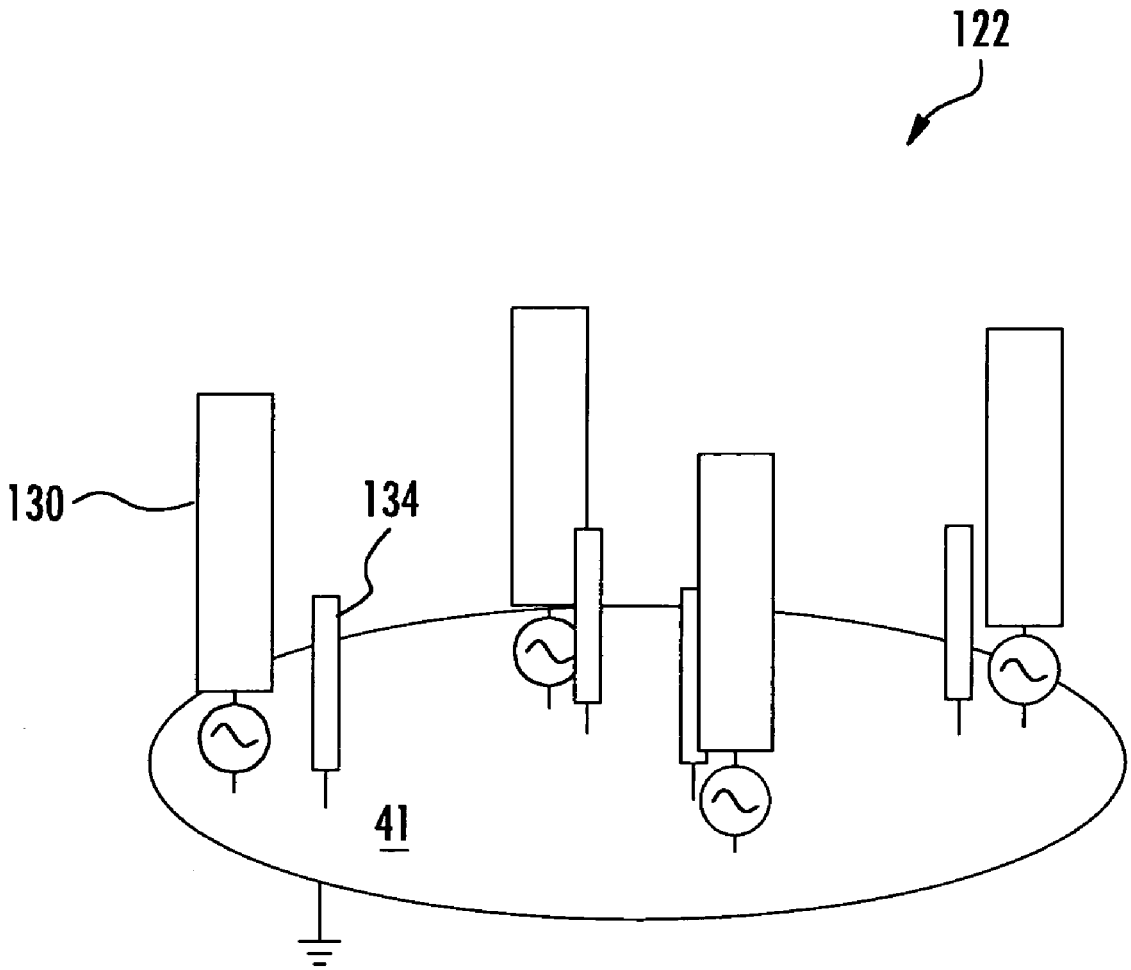
FIG. 13 is a schematic diagram of a phased array antenna in accordance with the present invention.

In another embodiment, the antenna elements 30, 32 are all active elements and are combined with independently adjustable phase shifters to provide a phased array antenna, as illustrated in FIG. 13. In this embodiment, multiple directional beams as well as an omni-directional beam in the azimuth direction can be generated. Tuning elements 134 are used to match the input impedances of the multiple antenna modes of the phased array antenna 122 by tuning each of the active antenna elements 130. As with the switched beam antenna 22, the tuning elements 134 are sized so that they do not interfere with the antenna patterns generated by the phased array antenna 122. Size, shape and spacing of the tuning elements 134 vary between the particular applications of the phased array antenna 122.

Essentially, the phased array antenna 122 includes multiple antenna elements 130 and a like number less one of adjustable phase shifters, each respectively coupled to one of the antenna elements. The phase shifters are independently adjustable (i.e., programmable) to affect the phase of respective downlink/uplink signals to be received/transmitted on each of the antenna elements 130.

A summation circuit is also coupled to each phase shifter and provides respective uplink signals from the subscriber device to each of the phase shifters for transmission from the subscriber device. The summation circuit also receives and combines the respective downlink signals from each of the phase shifters into one received downlink signal provided to the subscriber device 20.

The phase shifters are also independently adjustable to affect the phase of the downlink signals received at the subscriber device 20 on each of the antenna elements. By adjusting phase for downlink link signals, the phased array antenna 122 provides rejection of signals that are received and that are not transmitted from a similar direction as are the downlink signals intended for the subscriber device 20.

Yet another aspect of the present invention is to provide a method for matching an input impedance of a smart antenna 22 comprising a ground plane 41; an active antenna element 30 adjacent the ground plane and having a radio frequency (RF) input associated therewith; and a plurality of passive antenna elements 32 adjacent the ground plane. A plurality of impedance elements 60 is connected to the ground plane 40 and is selectively connectable to the plurality of passive antenna elements 32 for antenna beam steering. The method comprises tuning the plurality of passive antenna elements 32 by positioning a plurality of tuning elements 34 adjacent thereof so that the input impedance of the RF input 68 of the active antenna element 30 remains relatively constant during the antenna beam steering.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A smart antenna comprising:

a ground plane;

an active antenna element adjacent said ground plane and having a radio frequency (RF) input associated therewith;

a plurality of passive antenna elements adjacent said ground plane;

a plurality of impedance elements connected to said ground plane and being selectively connectable to said plurality of passive antenna elements for antenna beam steering; and a plurality of tuning elements adjacent said plurality of passive antenna elements for tuning thereof so that an input impedance of the RF input of said active antenna element remains relatively constant during the antenna beam steering.

2. A smart antenna according to claim 1 wherein said plurality of tuning elements are connected to ground.

3. A smart antenna according to claim 1 wherein said plurality of passive antenna elements define at least one resonant frequency; and wherein said plurality of tuning elements define at least one sub-resonant frequency.

4. A smart antenna according to claim 1 wherein said plurality of tuning elements is positioned between said active antenna element and said plurality of passive antenna elements.

5. A smart antenna according to claim 1 wherein at least one tuning element is adjacent a respective passive antenna element for tuning thereof.

6. A smart antenna according to claim 1 wherein each tuning element is positioned adjacent a respective passive antenna element within a range of about 1/20 to 1/100 the wavelength of the operating frequency of the smart antenna.

7. A smart antenna according to claim 1 wherein each tuning element has a height that is within a range of about 20 to 80% of a height of the plurality of passive antenna elements.

8. A smart antenna according to claim 1 further comprising a dielectric substrate, and wherein said active antenna element, said plurality of passive antenna elements and said tuning elements are each carried by said dielectric substrate.

9. A smart antenna according to claim 1 wherein said active antenna element has a T-shape.

10. A smart antenna according to claim 9 wherein said active antenna element includes a bottom portion and a top portion connected thereto for defining the T-shape, and wherein the bottom portion has a meandering shape.

11. A smart antenna according to claim 10 wherein the top portion is symmetrically arranged with respect to the first portion, and includes a pair of inverted L-shaped ends.

12. A smart antenna according to claim 1 where each passive antenna element comprises an inverted L-shaped portion laterally adjacent said active antenna element.

13. A smart antenna according to claim 1 further comprising a plurality of switches for selectively connecting said plurality of passive antenna elements to said plurality of impedance elements.

14. A smart antenna according to claim 1 wherein each impedance element is associated with a respective passive antenna element, each impedance element comprising an inductive load and a capacitive load, with said inductive load and said capacitive load being selectively connectable to the respective passive antenna element.

15. A mobile subscriber unit comprising:

a smart antenna for generating a plurality of antenna beams;

a beam selector controller connected to said smart antenna for selecting one of the plurality of antenna beams; and a transceiver connected to said beam selector and to said smart antenna;

said smart antenna comprising a ground plane, an active antenna element adjacent said ground plane and having a radio frequency (RF) input associated therewith, a plurality of passive antenna elements adjacent said ground plane, a plurality of impedance elements connected to said ground plane and being selectively connectable to said plurality of passive antenna elements for selecting one of the plurality of antenna beams, and a plurality of tuning elements adjacent said plurality of passive antenna elements so that an input impedance of the RF input of said active antenna element remains relatively constant among the selected antenna beams.

16. A mobile subscriber unit according to claim 15 wherein said plurality of tuning elements are connected to ground.

17. A mobile subscriber unit according to claim 16 wherein said plurality of passive antenna elements define at least one resonant frequency; and wherein said plurality of tuning elements define at least one sub-resonant frequency.

18. A mobile subscriber unit according to claim 16 wherein said plurality of tuning elements is positioned between said active antenna element and said plurality of passive antenna elements.

19. A mobile subscriber unit according to claim 16 wherein at least one tuning element is adjacent a respective passive antenna element for tuning thereof.

20. A mobile subscriber unit according to claim 16 wherein each tuning element is positioned adjacent a respective passive antenna element within a range of about 1/20 to 1/100 the wavelength of the operating frequency of the smart antenna.

21. A mobile subscriber unit according to claim 16 wherein each tuning element has a height that is within a range of about 20 to 80% of a height of the plurality of passive antenna elements.

22. A mobile subscriber unit according to claim 16 wherein said smart antenna further comprises a dielectric substrate, and wherein said active antenna element, said plurality of passive antenna elements and said tuning elements are each carried by said dielectric substrate.

23. A mobile subscriber unit according to claim 16 wherein said active antenna element has a T-shape.

24. A mobile subscriber unit according to claim 16 where each passive antenna element comprises an inverted L-shaped portion laterally adjacent said active antenna element.

25. A mobile subscriber unit according to claim 16 wherein said smart antenna further comprises a plurality of switches for selectively connecting said plurality of passive antenna elements to said plurality of impedance elements.

26. A mobile subscriber unit according to claim 16 wherein each impedance element is associated with a respective passive antenna element, each impedance element comprising an inductive load and a capacitive load, with said inductive load and said capacitive load being selectively connectable to the respective passive antenna element.

27. A method for matching an input impedance of a smart antenna comprising a ground plane; an active antenna element adjacent the ground plane and having a radio frequency (RF) input associated therewith; a plurality of passive antenna elements adjacent the ground plane; and a plurality of impedance elements connected to the ground plane and being selectively connectable to the plurality of passive antenna elements for antenna beam steering, the method comprising:

tuning the plurality of passive antenna elements by positioning a plurality of tuning elements adjacent thereof so that the input impedance of the RF input of the active antenna element remains relatively constant during the antenna beam steering.

28. A method according to claim 27 further comprising connected to the plurality of tuning elements to ground.

29. A method according to claim 27 wherein the plurality of passive antenna elements define at least one resonant frequency; and wherein the plurality of tuning elements define at least one sub-resonant frequency.

30. A method according to claim 27 wherein the plurality of tuning elements is positioned between the active antenna element and the plurality of passive antenna elements.

31. A method according to claim 27 wherein at least one tuning element is adjacent a respective passive antenna element for tuning thereof.

32. A method according to claim 27 wherein each tuning element is positioned adjacent a respective passive antenna element within a range of about 1/20 to 1/100 the wavelength of the operating frequency of the smart antenna.

33. A method according to claim 27 wherein each tuning element has a height that is within a range of about 20 to 80% of a height of the plurality of passive antenna elements.

34. A method according to claim 27 further comprising using a Smith chart for determining at least one of size and location of the plurality of tuning elements.

* * * * *